US006700488B1

(12) United States Patent
Leyden et al.

(10) Patent No.: US 6,700,488 B1
(45) Date of Patent: Mar. 2, 2004

(54) SECURITY SYSTEM FOR A PORTABLE DEVICE

(75) Inventors: Roger J. Leyden, Willow Springs, IL (US); Terrance J. Surma, Bloomingdale, IL (US); James Koko, Elgin, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 0 days.

(21) Appl. No.: 10/235,412

(22) Filed: Sep. 5, 2002

(51) Int. Cl.[7] ..... G08B 13/14
(52) U.S. Cl. ..... 340/568.1; 340/571
(58) Field of Search ..... 340/568.1, 568.2, 340/568.3, 568.4, 568.5, 568.6, 568.7, 568.8, 571, 686.1, 687

(56) References Cited

U.S. PATENT DOCUMENTS 3,938,124 A * 2/1976 Way et al. ..... 340/531
5,172,098 A 12/1992 Leyden et al.
5,331,306 A * 7/1994 Carruthers, II ..... 340/425.5
5,341,124 A 8/1994 Leyden et al.
5,408,213 A * 4/1995 Ungarsohn ..... 340/427
5,421,667 A 6/1995 Leyden et al.
5,552,771 A 9/1996 Leyden et al.
5,565,848 A 10/1996 Leyden et al.
5,246,183 A 6/1997 Leyden
5,648,757 A * 7/1997 Vernace et al. ..... 340/539.32
5,656,996 A * 8/1997 Houser ..... 340/541
5,676,258 A * 10/1997 Leyden et al. ..... 211/7
5,861,807 A 1/1999 Leyden et al.
6,027,277 A 2/2000 Leyden et al.
6,039,498 A 3/2000 Leyden et al.
6,087,939 A 7/2000 Leyden et al.
6,177,869 B1 * 1/2001 McDaid ..... 340/568.1
6,236,312 B1 * 5/2001 Chitsazan et al. ..... 340/539.32
6,243,005 B1 * 6/2001 Haimovich et al. ..... 340/427
6,326,890 B1 * 12/2001 Costa ..... 340/572.9
RE37,590 E 3/2002 Leyden et al.
6,380,855 B1 * 4/2002 Ott ..... 340/568.2

* cited by examiner

*Primary Examiner*—Nina Tong
(74) *Attorney, Agent, or Firm*—Wood, Phillips, Katz, Clark & Mortimer

(57) ABSTRACT

The combination of a portable device and a security system. The security system has a first holding portion and a second holding portion spaced from the first holding portion. The first and second holding portions are movable relative to each other to selectively change a spacing distance between the first and second holding portions. The first and second holding portions captively engage the portable device with the first and second holding portions in an engaged state and are movable relative to each other from the engaged state to a release state. A setting mechanism can be selectively placed in a secured state and an unsecured state. The setting mechanism in the secured state causes the first and second holding portions to be maintained relative to each other in the engaged state. The setting mechanism in the unsecured state allows the first and second holding elements to be moved relative to each other from the engaged state into the release state. An access assembly has first and second states. In the first state, the access assembly permits the setting mechanism to be changed from the secured state into the unsecured state. The access assembly in the second state prevents the setting mechanism from being changed from the secured state into the unsecured state.

36 Claims, 5 Drawing Sheets

SECURITY SYSTEM FOR A PORTABLE DEVICE

BACKGROUND OF THE INVENTION

1. Field of the Invention

This invention relates to security systems and, more particularly, to a security system that is useable to confine repositioning of a portable device.

2. Background Art

Theft of portable consumer items is rampant worldwide. The trend in merchandising, to allow potential customers to handle and operate products without direct supervision by store personnel, has contributed to the theft problem. This is particularly true in the electronics industry wherein myriad competitive products are made available with different designs and features. A decision to purchase may be deferred until a customer has had an opportunity to pick up and test several different products. It is impractical and economically infeasible to man stores with enough employees to remove products from secured spaces and monitor their use by customers on a one-by-one basis. This has led to the mass display of virtually all available products in a store in a manner that allows for unsupervised handling, inspection, and operation thereof.

This mass display scheme is common in merchandising of portable electronic goods. In recent years, there has been an explosion in the sales of electronic devices which store and process information and are useable for electronic communication. The trend with these devices, commonly referred to as PDA's (personal digital assistant devices) has been to increase the capabilities and versatility of these devices while reducing their size so that they are more conveniently transportable by users.

The PDA industry has become highly competitive. Many different companies are offering such products with a wide range of size, feel, functionality, and aesthetics. Those purchasing PDA's commonly wish to operate competitive brands of PDA to make a comparison before consummating a purchase. This has led to the setup of PDA display sections in many consumer electronics stores. Users are allowed to view and operate a number of competitors' PDA devices at such stations.

The increasing popularity of PDA devices has also made them an increasingly attractive target for thieves. The sophistication of these devices is such that they are, while small, quite expensive. A skilled thief may abscond with a PDA without detection. Given the price of the PDA's, losses due to theft in retail establishments of this type of device may become very significant.

As a consequence, purveyors of electronic devices have constantly been seeking ways to secure PDA's against theft while at the same time making them accessible for handling and operation. Ideally, the would-be purchaser is allowed to operate the PDA as he/she would normally do without contending with burdensome and intrusive security systems.

As is often the case, designers of security systems are faced with many, often competing, objectives. A security system must first of all be effective in preventing theft. At the same time, the security system should not be cumbersome or significantly impair operation and inspection of the device. Finally, the security system must be designed so that its use is cost justified in retail establishments. Ideally, such security systems are useable to releasably adapt to the articles without damage thereto so that the secured demonstration articles may be ultimately sold.

Many diverse security systems for portable consumer devices are currently offered. These systems are generally categorized as mechanical or electrical, or combinations thereof. In a purely mechanical system, a cable tether is used. One end of the cable is secured to a support, with the other end secured to the article to be monitored. The length of the cable dictates the range of movement of the article away from the support. One common means of connection of the cable to the article is to provide an end fitting on the cable and to secure the end fitting to the article as by an adhesive pad or by applying adhesive directly to the article. Failure of this type of system may be attributable to an inadequate adhesive bond or one that deteriorates over time. The cable's severance, or removal of the end fitting from the object, permit the system to be defeated.

Electronic systems commonly use an end fitting which is armed by being attached to the device. Removal of the end fitting, or severance of a conductive cord, will break a circuit that activates an alarm so as to produce an audible or visually detectable signal indicating that the system has been compromised. Commonly, such electronic systems utilize an end fitting which is directly connected to the device, as shown for example in U.S. Pat. No. 5,172,098.

By directly adhering end fittings to a device, there is a possibility that the end fitting can be removed without a detectable breach. Still further, a positively secured end fitting may damage or at least aesthetically compromise the product to which it is attached, thus making it unfit for sale at a near value price.

SUMMARY OF THE INVENTION

In one form, the invention is directed to the combination of a portable device and a security system. The security system has a first holding portion and a second holding portion spaced from the first holding portion. The first and second holding portions are movable relative to each other to selectively change a spacing distance between the first and second holding portions. The first and second holding portions captively engage the portable device with the first and second holding portions in an engaged state and are movable relative to each other from the engaged state to a release state. A setting mechanism can be selectively placed in a secured state and an unsecured state. The setting mechanism in the secured state causes the first and second holding portions to be maintained relative to each other in the engaged state. The setting mechanism in the unsecured state allows the first and second holding elements to be moved relative to each other from the engaged state into the release state. An access assembly has first and second states. In the first state, the access assembly permits the setting mechanism to be changed from the secured state into the unsecured state. The access assembly in the second state prevents the setting mechanism from being changed from the secured state into the unsecured state.

In one form, the security system has a frame, a mounting element on the frame, and a support for reception of the mounting element.

In one form, the support is a stand with a receptacle and the mounting element is releasably directed into the receptacle to maintain the portable device in a display state relative to the stand.

In one form, the first holding portion is movable guidingly relative to the frame to change the spacing distance between the first and second holding portions.

In one form, the frame defines an elongate slot and the first holding element has a post that is movable guidingly within the elongate slot to change the spacing distance between the first and second holding portions.

In one form, the setting mechanism fixes the location of the post within the elongate slot.

In one form, the post has a threaded portion and a nut is attached to the threaded portion and tightened to place the setting mechanism in the secured state.

In one form, the access assembly consists of a door that is guidingly movable relative to the frame between first and second positions corresponding to the first and second states for the access assembly.

In one form, the door in the second position blocks access to the setting mechanism from a first location and in the first position permits access to the setting mechanism from the first location to allow the setting mechanism to be changed between secured and unsecured states.

The door may be pivotable between the first and second positions.

In one form, the portable device is a personal digital assistant device.

In one form, an elongate cable is attached to the frame and a support.

The combination may further include a generator for a detectable signal. In one form, the elongate cable defines at least one electrically conductive path which, if interrupted, causes the generator to produce a detectable signal.

In one form, the portable device has a first corner and the first holding portion defines a first receptacle into which the first corner projects.

The portable device may have a second corner, with the second holding portion defining a second receptacle into which the second corner projects with the first and second holding portions in the engaged state.

In one form, the first and second corners on the portable device project in different directions so that with the first and second holding portions in the engaged state, the first and second corners cannot be withdrawn from the first and second receptacles so that the portable device cannot be separated from the security system.

The security system may further include a third holding portion that is movable relative to each of the first and second holding portions and engages the portable device to cooperate with the first and second holding portions with the first and second holding portions in the engaged state to maintain the portable device connected to the security system.

The invention is also directed to a security system for use in conjunction with a portable device, as described above.

The invention is still further directed to a method of securing a portable device using a security system with first and second holding portions, a setting mechanism, and an access assembly. The method includes the steps of: relatively repositioning the first and second holding portions into a release state; placing the portable device in a preassembly position relative to the first and second holding portions with the first and second holding portions in the release state; with the portable device in the preassembly position relatively repositioning the first and second holding portions from the release state into an engaged state wherein the portable device is held by the first and second holding portions; placing the setting mechanism in an unsecured state wherein the first and second holding portions can be moved relative to each other between the engaged and release state; placing the access assembly in a first state, wherein the setting mechanism can be accessed at a first location to change the setting mechanism between the unsecured state and a secured state, wherein the setting mechanism causes the first and second holding portions to be maintained in a desired relative position; with the first and second holding portions in the engaged state and the access assembly in the first state, accessing the setting mechanism at the first location and changing the setting mechanism from the unsecured state into the secured state; and changing the access assembly from the first state into the second state to thereby prevent access to the setting mechanism at the first location to change the setting mechanism from the secured state into the unsecured state;

The method may further include the step of connecting the security system to a base/support.

In one form, the security system has a frame and the method further includes the steps of providing a support, fixedly connecting the support to a base, and releasably connecting the frame to the support.

In one form, there is a mounting element on the frame and a receptacle on the support. The method may further include the steps of directing the mounting element into the receptacle to maintain the portable device in a display state relative to the support.

The method may further include the step of connecting a cable to the frame and to the base at a second location to thereby limit movement of the frame away from the second location.

In one form, the cable has a conductive element which defines a conductive path. The method may further include the step of providing a generator capable of producing a detectable signal in the event that the conductive path is interrupted.

In one form, the portable device is a personal digital assistant device, with the method further including the step of operating the personal assist device with the personal assist device operatively connected to the security system.

DETAILED DESCRIPTION OF THE DRAWINGS

Figure 1:
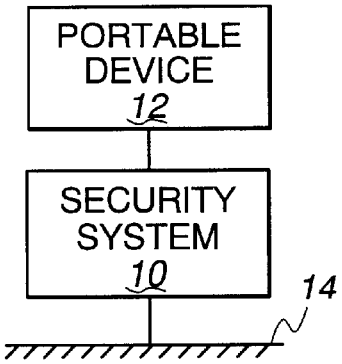
FIG. 1 is a schematic representation of a system, according to the present invention, for securing a portable device relative to a base/support.

In FIG. 1, a schematic representation of the invention is shown consisting of a security system 10 for maintaining a portable device 12 in a desired position relative to a base/support 14. The precise nature of the portable device 12 is not critical to the present invention. As an example, the invention contemplates securing any device that is capable of storing data, processing data, and/or electronically communicating data. The exemplary portable device 12 is a personal digital assistant device (PDA device), but could be any device with a case profile that can be accepted by the security system. Regardless of the nature of the portable device 12, the security system 10 is designed to prevent removal of the portable device 12 from a prescribed location. This can be accomplished using any of a number of different system configurations.

Figure 2:
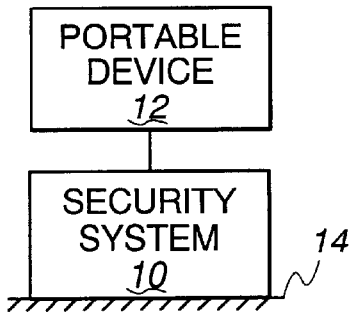
FIG. 2 is a view as in FIG. 1 wherein the security system 10 is secured directly to the base/support.
Figure 3:
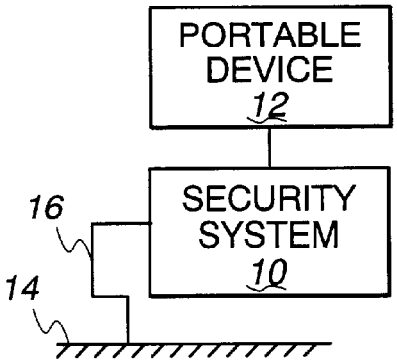
FIG. 3 is a view as in FIGS. 1 and 2 with the security system secured to the base/support through a cable.

In FIG. 2, the security system 10 with the portable device 12 held thereby is shown fixedly attached directly to the base/support 14. In FIG. 3, the security system 10, holding the portable device 12, is shown connected to the base/support 14 through a flexible cable 16. The cable 16 permits the security system 10, with the portable device held thereby, to be manipulated within a range permitted by the length of the flexible cable 16.

Figure 4:
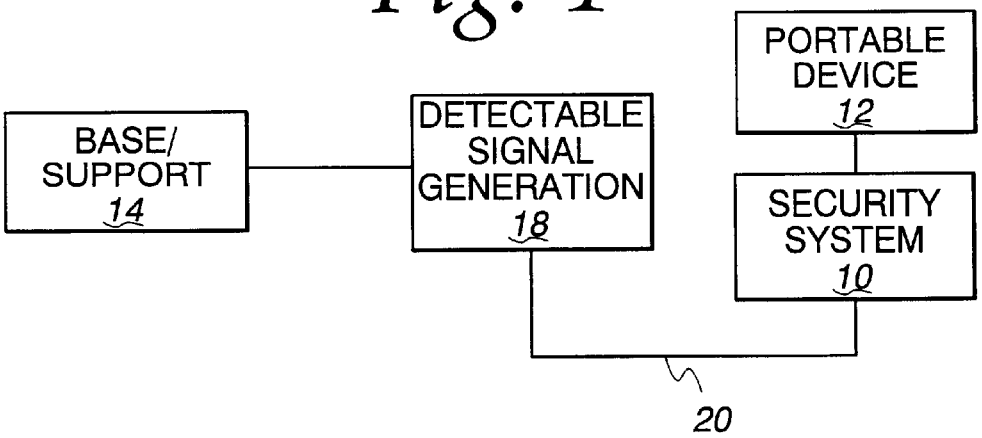
FIG. 4 is a view as in FIGS. 1–3 and incorporating a detectable signal generator which is actuated to produce a signal in the event of a breach of the system.

In FIG. 4, the security system 10, with the portable device 12 held thereby, is connected to a detectable signal generator 18 mounted upon the base/support 14. Through a cable 20, a conductive path is defined between the detectable signal generator 18 and the security system 10. In the event that the conductive path is interrupted, the detectable signal generator 18 produces a signal which indicates that the system security has been compromised. The cable 20 permits repositioning of the security system 10 and portable device 12, held thereby, within a range dictated by the length of the cable 20, and also provides added security in the event that the cable 20 is severed or separated from the security system 10. Details of an alarm system, capable of generating a detectable signal and useable as part of the security system 10, are shown in U.S. Pat. No. 5,172,098, which is incorporated herein by reference.

Figure 11:
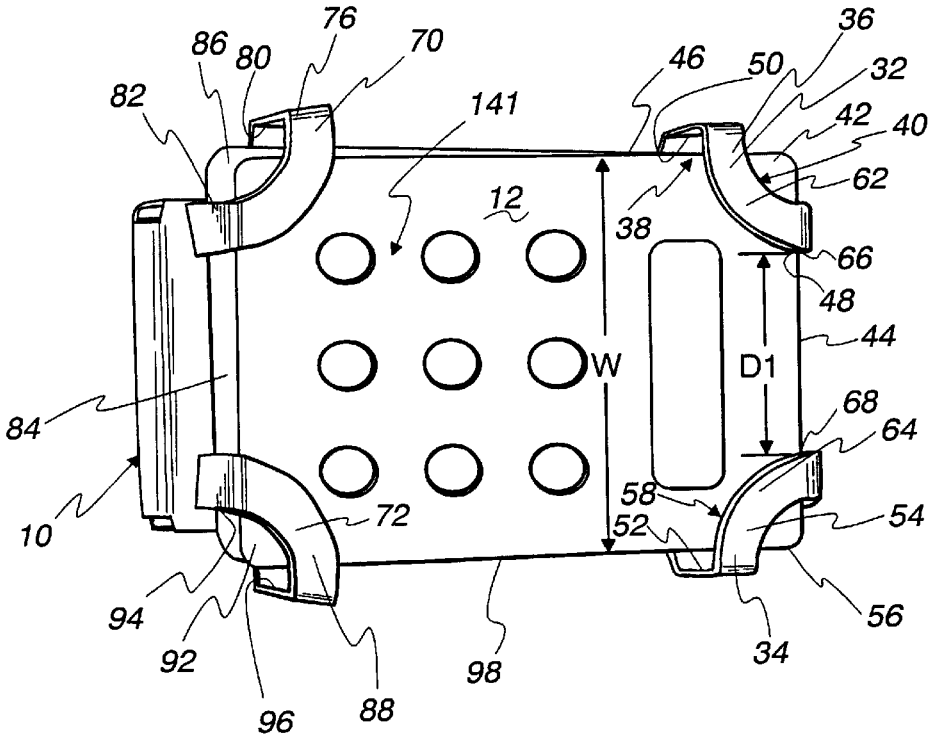
FIG. 11 is a view as in FIG. 6 with the portable device operatively connected to the part of the security system.

Referring to FIGS. 5–11, details of the security system 10, and its cooperation with the portable device 12, will be described in detail. The security system 10 consists of a frame 26 having a generally flat support pad 28 with a flat mounting surface 30 against which the portable device 12 is placed. The security system 10 has first and second holding portions 32, 34 that are fixedly attached to the frame 26. The holding portions 32, 34 are mirror images of each other. Exemplary holding portion 32 has a wall 36 which extends continuously around a receptacle 38. Essentially, the first holding portion 32 has a squared, cup shape with a truncation at 40 which allows a corner 42 of the portable device 12 to be directed through the receptacle 38 into an operative position, as shown at FIG. 11, wherein the top and side walls, 44, 46, respectively, on the portable device 12 confront orthogonal surfaces 48, 50, respectively, on the wall 36.

The holding portion 34 is spaced from the holding portion 32 so that the distance D (FIG. 6) between the surface 50 and a facing surface 52 on a wall 54 on the holding portion 34 is slightly greater than the typical width dimension W (FIG. 11) of the type of portable device 12 to be held by the security system. As can be seen in FIG. 11, with the corner 42 of the portable device 12 directed through the receptacle 38 so that the top wall 44 on the portable device 12 abuts the wall surface 48, and a spaced corner 56 on the portable device 12 directed through a receptacle 58 defined by the holding portion 34 to against a wall surface 60 on the holding portion 34, the width W of the portable device 12 is loosely accommodated between the facing surfaces 50, 52. In this position, the portable device 12 is confined in movement away from the mounting surface 30 by wall portions 62, 64 on the holding portions 32, 34, respectively, which extend angularly across the region of the corners 42, 56 of the portable device 12.

It should be understood that while the holding portions 32, 34 are shown as a fixed, integral part of the frame 26, one or both of the holding portions 32, 34 could be movable relative to the frame 26 to select the width dimension D between the surfaces 50, 52. By reason of the configuration of the holding portions 32, 34, the security system 10 with the fixed holding portions 32, 34 will accommodate a range of width dimensions for the portable device 12. The functional width capability for the security system 10 shown has a range from the distance D down to a smaller distance D1, shown in FIG. 11, between the edges 66, 68 of the wall portions 62, 64. Alternatively, each security system 10 can be customized to the width of a specific product.

The security system 10 further includes third and fourth holding portions 70, 72, which are shown to be identical in construction. However, this identical construction is not necessary. Exemplary holding portion 70 has a mounting portion 74 and a wall 76 extending around a receptacle 78. The wall 76 has the same general configuration as the walls 36, 54, i.e. a generally squared, cup shape that is truncated to define a pass through receptacle 78. The wall 70 defines a wall surface 80 to confront the side wall 46 of the portable device 12 and a wall surface 82 to confront the bottom wall 84 of the portable device 12 with the bottom corner 86 of the portable device 12 directed through the receptacle 78.

The holding portion 72 has a wall 88 which bounds a receptacle 90 through which the other bottom corner 92 of the portable device 12 extends. The wall 88 has a surface 94 to confront the bottom wall 84 of the portable device 12 and an orthogonal surface 96 to confront the side wall 98 of the portable device 12. The holding portion 72 has a mounting portion 100, corresponding to the mounting portion 74 on the holding portion 70.

The holding portions 70, 72 are mounted to the support pad 28 in the same manner. Exemplary holding portion 70 has a fixed, threaded post 102 projecting therefrom and through an elongate slot 104 in the support pad 28. By sliding the post 102 along the slot 104, the spacing distance between the holding portions 34, 72 can be varied. Once a desired spacing distance is established, a nut 106 on the threaded post 102 can be tightened to maintain the desired position of the holding portion 72 on the support pad 28. The holding portion 72 has a threaded post 108 which moves in an elongate slot 110 which runs in substantially parallel relationship to the elongate slot 104. A nut 112 is threaded to the post 108 to fix the position of the holding portion 72 relative to the support pad 28 and the holding portion 32.

Figure 5:
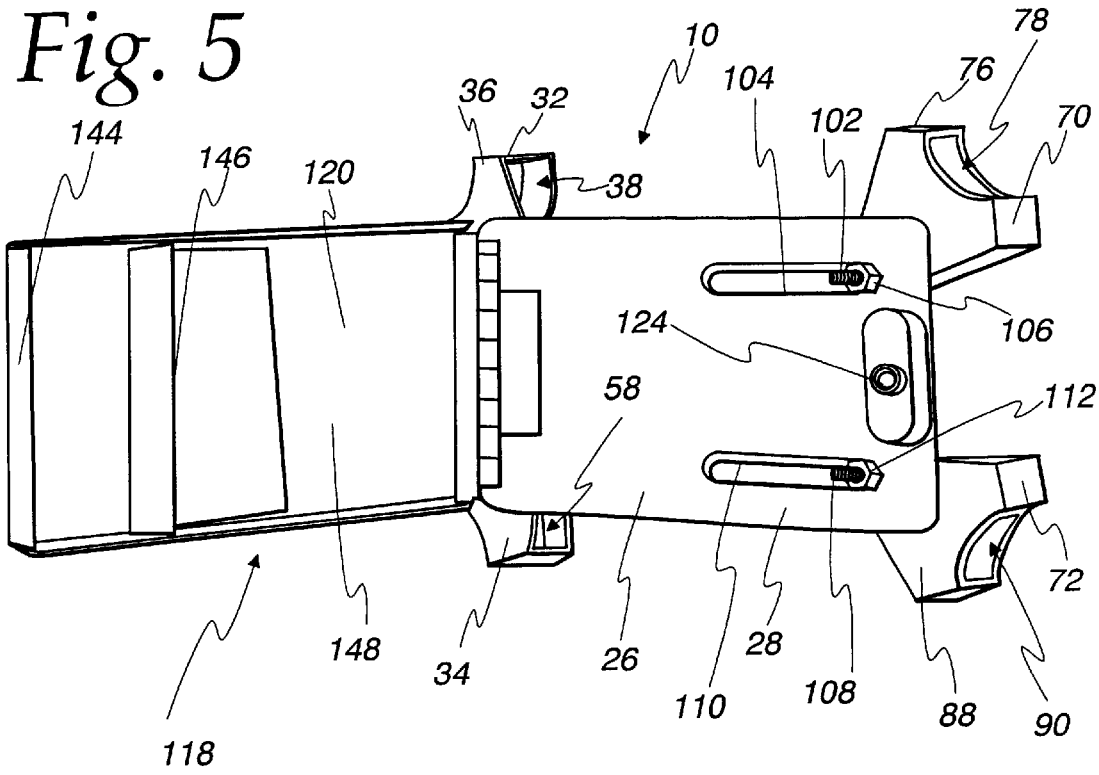
FIG. 5 is a perspective view of a part of the inventive security system consisting of a frame with a repositionable door thereon and with holding portions on the frame in a release state wherein a portable device can be placed on or removed from the security system.
Figure 6:
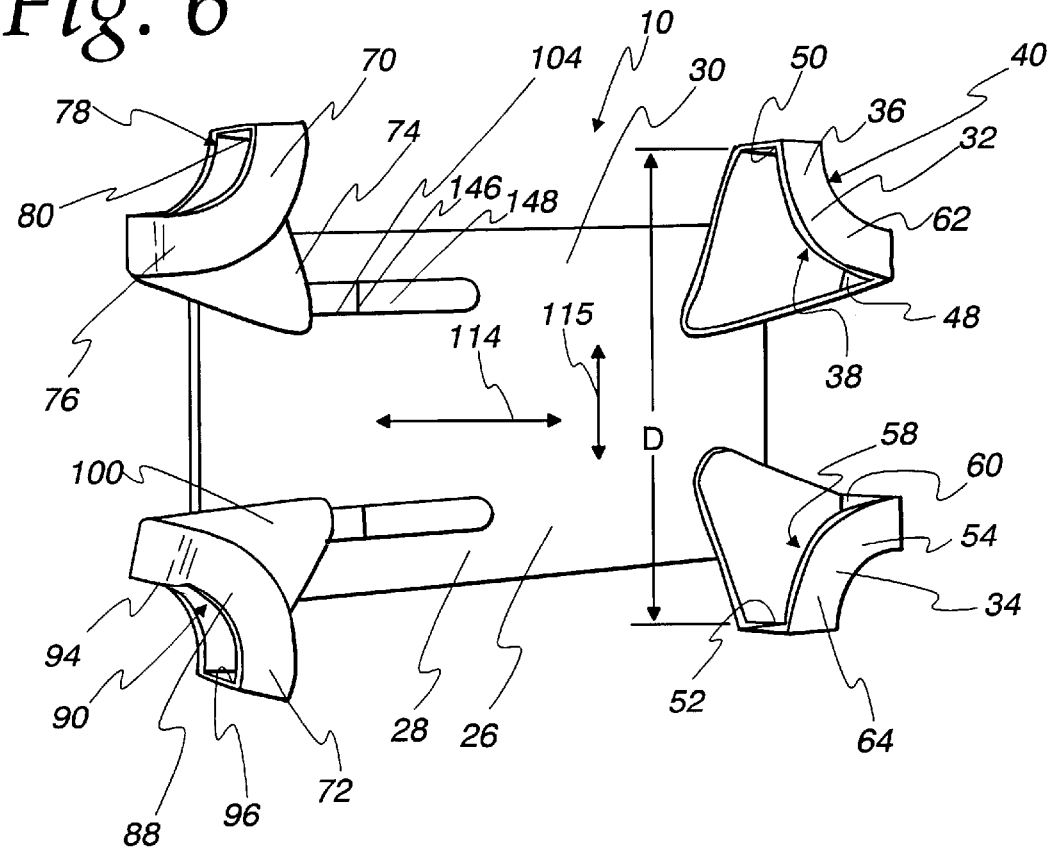
FIG. 6 is a perspective view of the security system taken from the side opposite that in FIG. 5.
Figure 7:
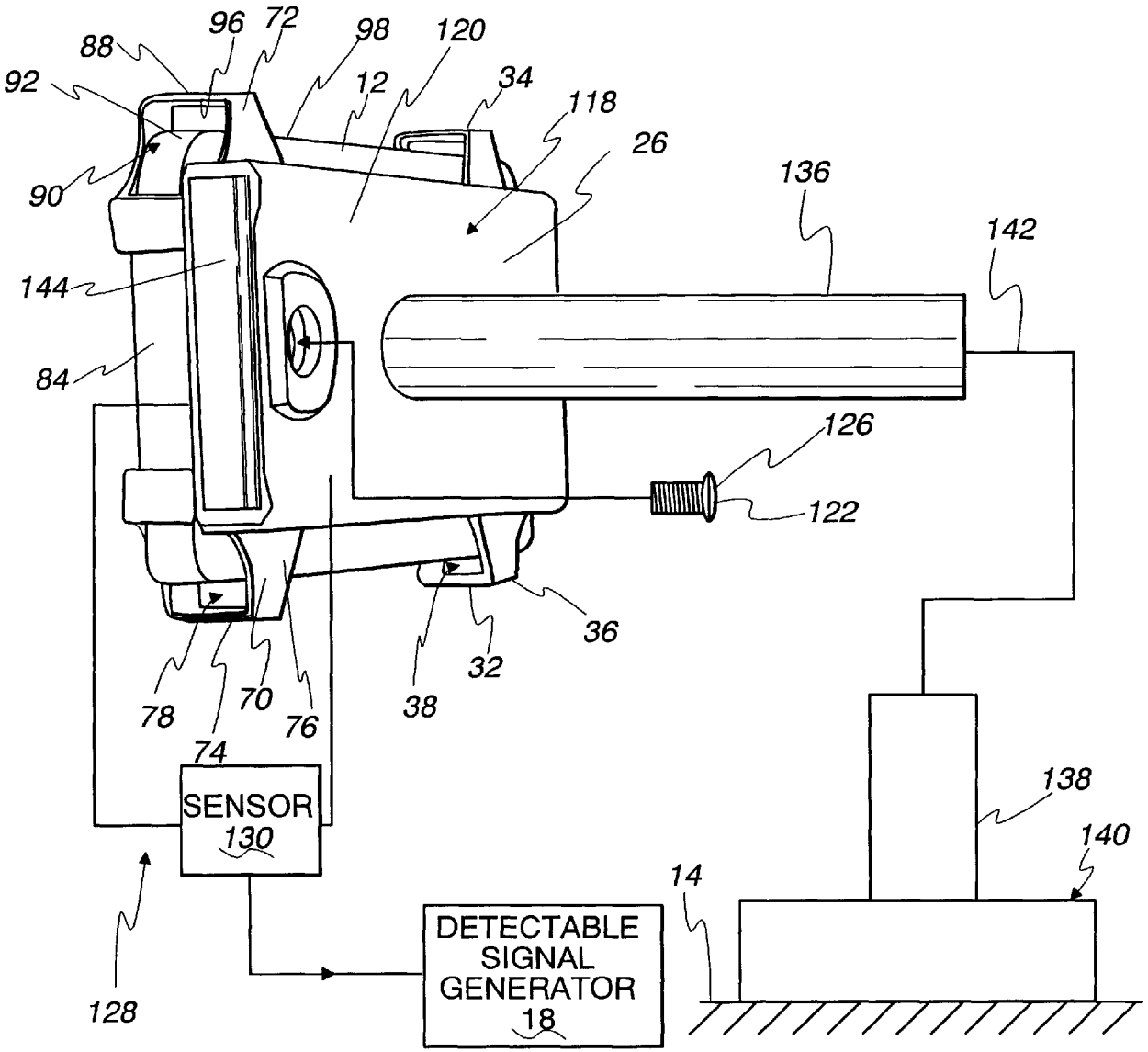
FIG. 7 is a partial schematic view of the part of the security system shown in FIGS. 5 and 6 and operatively connected to a portable device and having a mounting element which is capable of being attached to and separated from a stand and incorporating a cable which limits the range of movement of the security system relative to the stand.
Figure 8:
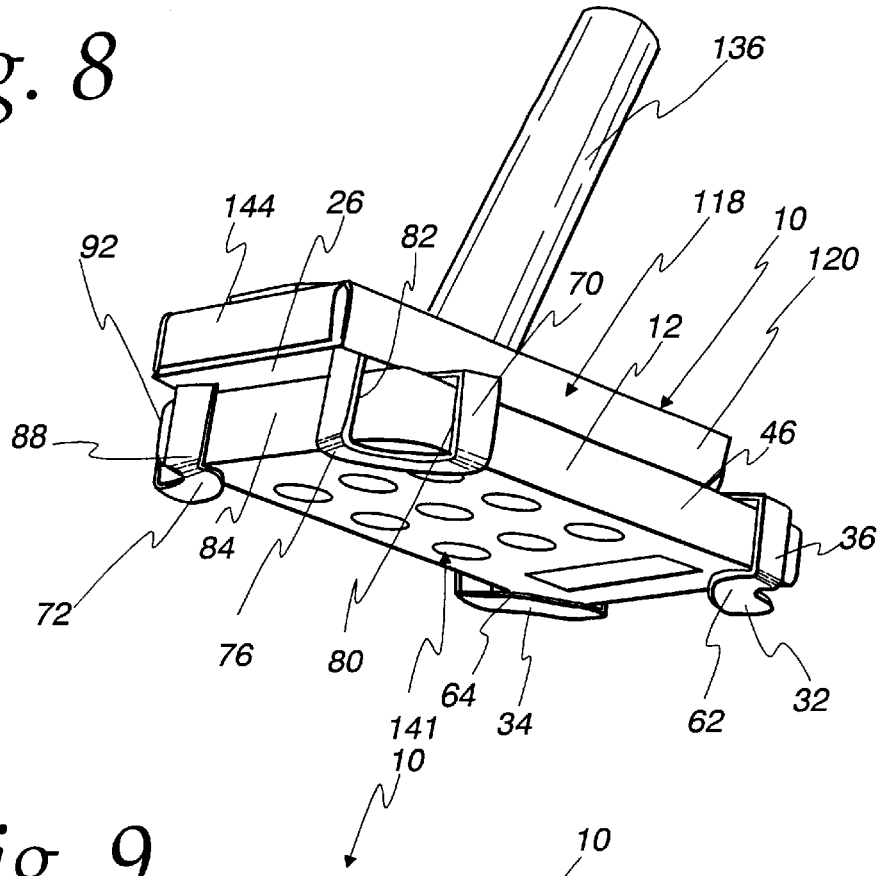
FIG. 8 is a perspective view of the part of the security system in FIGS. 5 and 6 with the portable device operatively connected thereto.
Figure 9:
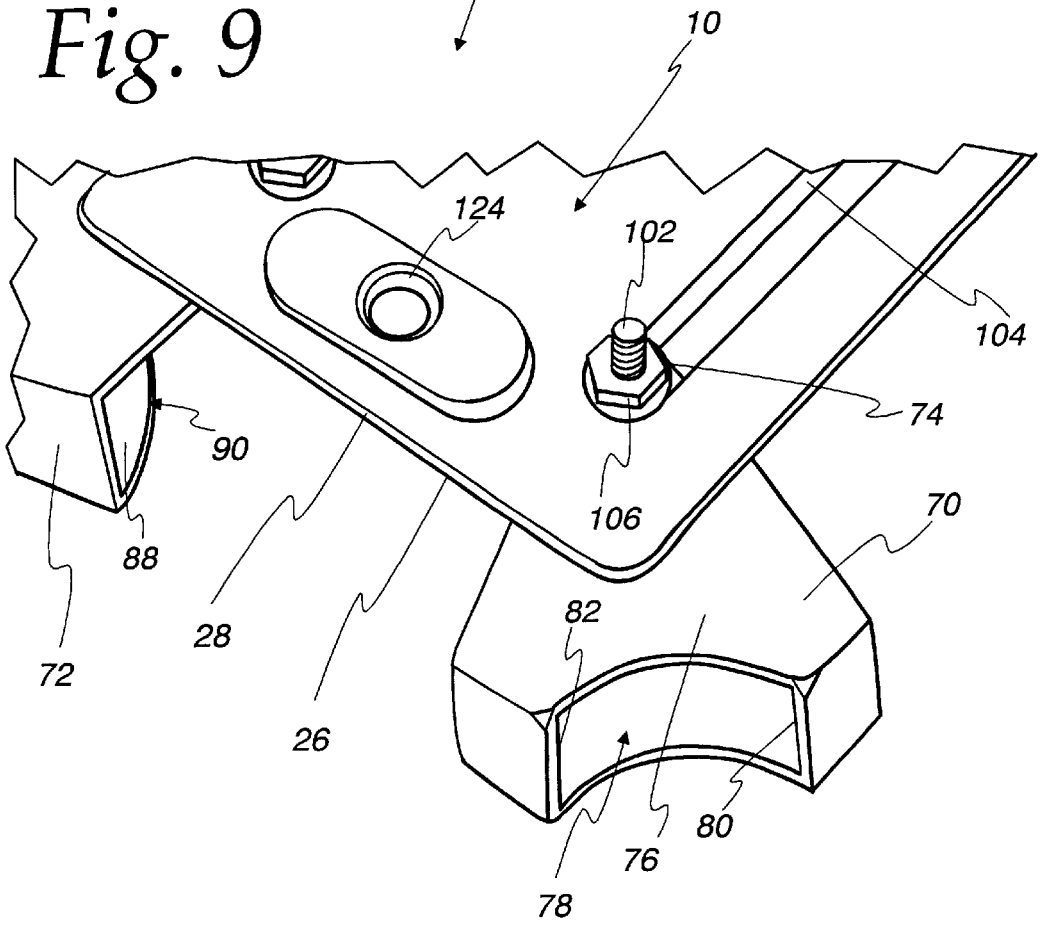
FIG. 9 is an enlarged, fragmentary, perspective view of the frame and one of the holding portions on the part of the security system in FIGS. 5, 6, and 8.
Figure 10:
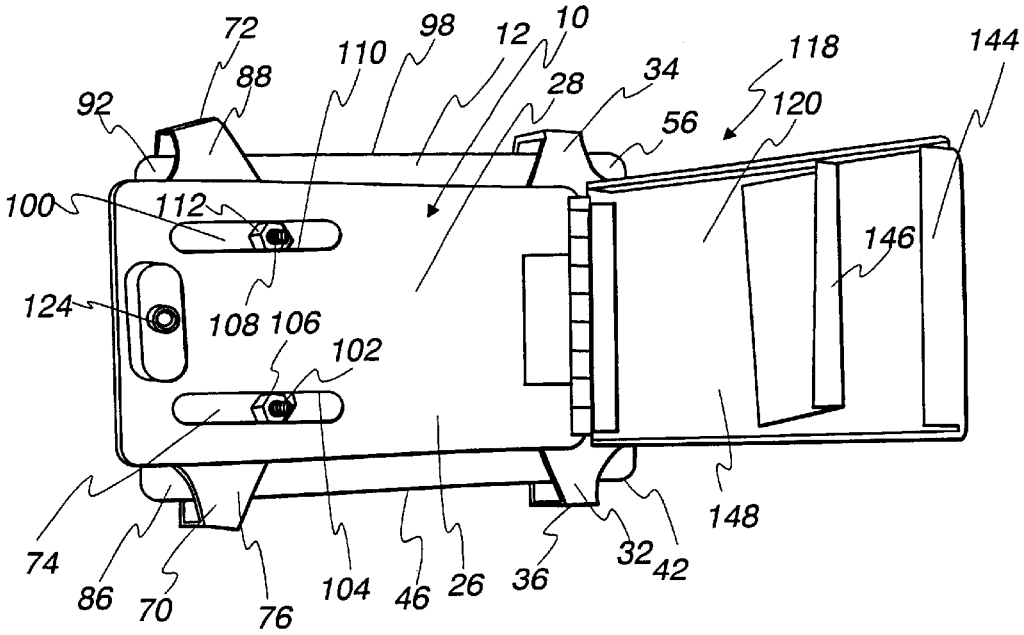
FIG. 10 is a view as in FIG. 5 with the holding portions in an engaged state and with the part of the security system operatively connected to the portable device.

The four holding portions 32, 34, 70, 72 cooperatively support the portable device 12 in an operative position, wherein it is captured toward the support pad 28. To effect this interconnection, the holding portions 70, 72 are translated by guided movement of the posts 102, 108 within the slots 104,110, towards ends thereof, as shown in FIG. 5, so that the holding portions 32, 34, 70, 72 thereby assume a release state. In the release state, the portable device 12 can be placed in a preassembly position, at or near the mounting surface 30 on the support pad 28, with the corners 42, 56 of the portable device 12 projected into the receptacles 38, 58, respectively. With the holding portions 32, 34, 70, 72 in their release state and the corners 42, 56 projected into the receptacles 38, 58, the bottom corners 86, 92 are aligned at the receptacles 78, 90. Thereafter, the holding portions 70, 72 can be translated in the direction of the holding portions 32, 34 towards an engaged state for the holding portions 32, 34, 70, 72, whereupon the corners 86, 92 move into the receptacles 78, 90. With the holding portions in the engaged state, the portable device 12 is confined against movement within the plane of the mounting surface 30 a) along a first line, as indicated by the double-headed arrow 114, by the wall surfaces 48, 60, 82, 94, and b) along a second line 115, orthogonal to the first line 114, by the wall surfaces 50, 52, 80, 96.

It should be understood that while four holding portions 32, 34, 70, 72 are shown, the security system 10 would operate with potentially two holding portions at spaced locations. As just one example, holding portions 34, 70 could themselves cooperate to maintain the portable device 12 positively to the security system 10. With the disclosed configuration of elements, a significant range of portable devices will be accommodated. That is, the elongate slots 104, 110 permit accommodation of devices with significant dimensional variation between the top wall 44 and bottom wall 84.

Once the portable device 12 is in place, and the holding portions 32, 34, 70, 72 are placed in the engaged state, the nuts 106, 112 are tightened to fix the spacing distance between the holding portions 32, 34, 70, 72. The nuts 106, 112, mounting portions 74, 100, and threaded posts 102, 108 cooperatively define a setting mechanism having secured and unsecured states. With the nuts 106, 112 loosened, the setting mechanism is in an unsecured state in which the holding portions 70, 72 are freely slidable as to release the portable device 12 or effect installation thereof. Once the holding portions 32, 34, 70, 72 are placed in the engaged state, the nuts 106, 112 are tightened to place the setting mechanism in the secured state. Access to the nuts 106, 112 can be conveniently gained at the mounting pad location on the side opposite to the mounting surface 30.

To prohibit access to the setting mechanism, including the nuts 106, 112, as to change the state of the setting mechanism, an access assembly is provided at 118. The access assembly 118 consists of a door 120 that is pivotably mounted to the frame 26 for movement relative thereto between a first position, shown in FIGS. 10 and 12, and a second position, shown in FIGS. 7 and 8. With the door 120 in its first position, the access assembly 118 is in a first state wherein access to the nuts 106, 112 can be gained without interference at the location on the mount support pad 28 on the side opposite to the mounting surface 30. By pivoting the door to its second position, the access assembly 118 is placed in the second state, wherein access to the nuts 106, 112 is blocked by the door 120 from the location at the support pad 28 at the side opposite to the mounting surface 30.

The door 120 is maintained in its second position by directing a threaded fastener 122 (FIG. 7) through the door 120 and into a threaded socket 124 on the support pad 28. To prevent a breach of the system, the head 126 of the fastener 122 may be provided with a special keying tool which is required to effect installation and removal of the fastener 122. Alternatively, the threaded fastener 122 may incorporate a safety feature as shown in U.S. Pat. No. 6,087,939, which is incorporated herein by reference. As a still further alternative, a sensing circuit 128 (FIG. 7) may be used to define a closed conductive circuit path with the door 120 in the second position. In the event the path is interrupted by reason of the door moving out of the second position, a sensor 130 is activated and produces a signal indicative of this state to the detectable signal generator 18. Other means are contemplated for maintaining the door 120 in the second position and/or giving a detectable indication that the door 120 has been moved from the second position into the first position therefor. The invention also contemplates that other means can be used to block access to the setting mechanism. For example, a sliding element might be used for this purpose.

To place the portable device 12 in a display state, a mounting element 136 is optionally used. The mounting element 136 is shown in the form of a cantilevered tube/post. The mounting element 136 may cooperate with a sleeve 138 (FIG. 7) on a stand 140 secured to the base/support 14. In this embodiment, the mounting element 136 is slidable into the sleeve 138 so that the operating face 141 of the portable device 12 is exposed for inspection and operation. In this embodiment, a flexible cable 142 can be used to connect between the frame 26 and the stand 140 or base/support 14 to confine the range of movement of the portable device 12 away from the stand 138. The cable 142 can be a purely mechanical cable or have a conductive element so as to incorporate an electronic sensing capability, as hereinabove described.

To rigidify the door 120 and to provide a redundant barrier to access to the nuts 106, 112, as from the end wall 144 of the door 120, an L-shaped reinforcement 146 is secured to the underside 148 of the door 120. The reinforcement 146 can be configured so as to also block the nuts 106,112 in the event that sliding of the mounting portions 74, 100 towards the release state is attempted.

The security system 10 shown permits a single construction to accommodate different configurations of portable devices. The security system 10 permits the portable device 12 to be positively maintained in place while permitting viewing and operation thereof.

The foregoing disclosure of specific embodiments is intended to be illustrative of the broad concepts comprehended by the invention.

What is claimed is:

1. In combination:

a) a portable device; and b) a security system comprising a first holding portion and a second holding portion spaced from the first holding portion, the first and second holding portions being movable relative to each other to selectively change a spacing distance between the first and second holding portions, the first and second holding portions captively engaging the portable device with the first and second holding portions in an engaged state and movable relative to each other from the engaged state to a release state;

a setting mechanism which can be selectively placed in a secured state and an unsecured state, the setting mechanism in the secured state causing the first and second holding portions to be maintained relative to each other in the engaged state, the setting mechanism in the unsecured state allowing the first and second holding elements to be moved relative to each other from the engaged state into the release state; and an access assembly having first and second states, the access assembly in the first state permitting the setting mechanism to be changed from the secured state into the unsecured state, the access assembly in the second state preventing the setting mechanism from being changed from the secured state into the unsecured state.

2. The combination according to claim 1 wherein the security system further comprises a frame, a mounting element on the frame, and a support for reception of the mounting element.

3. The combination according to claim 2 wherein the support comprises a stand with a receptacle and the mounting element is releasably directed into the receptacle to maintain the portable device in a display state relative to the stand.

4. The combination according to claim 1 wherein the security system comprises a frame and the first holding portion is movable guidingly relative to the frame to change the spacing distance between the first and second holding portions.

5. The combination according to claim 4 wherein the frame defines an elongate slot and the first holding element has a post that is movable guidingly within the elongate slot to change the spacing distance between the first and second holding portions.

6. The combination according to claim 5 wherein the setting mechanism in the secured state fixes the location of the post within the elongate slot.

7. The combination according to claim 6 wherein the post has a threaded portion and a nut is attached to the threaded portion and is tightened to place the setting mechanism in the secured state.

8. The combination according to claim 1 wherein the security system comprises a frame and the access assembly comprises a door that is guidingly movable relative to the frame between first and second positions corresponding respectively to the first and second states for the access assembly.

9. The combination according to claim 8 wherein the door in the second position blocks access to the setting mechanism from a first location and in the first position permits access to the setting mechanism from the first location to allow the setting mechanism to be changed between the secured and unsecured states.

10. The combination according to claim 9 wherein the door is pivotable relative to the frame between the first and second positions.

11. The combination according to claim 1 wherein the portable deice comprises a personal digital assistant device.

12. The combination according to claim 1 wherein the security system comprises a frame and an elongate cable attached to the frame and a support.

13. The combination according to claim 12 wherein the security system further comprises a generator for a detectable signal and the elongate cable defines at least one electrically conductive path which, if interrupted, causes the generator to produce a detectable signal.

14. The combination according to claim 1 wherein the portable device has a first corner and the first holding portion defines a first receptacle into which the first corner projects with the first and second holding portions in the engaged state.

15. The combination according to claim 14 wherein the portable device has a second corner and the second holding portion defines a second receptacle into which the second corner projects with the first and second holding portions in the engaged state.

16. The combination according to claim 15 wherein the first and second corners project in different directions so that with the first and second holding portions in the engaged state the first and second corners cannot be withdrawn from the first and second receptacles so that the portable device cannot be separated from the security system.

17. The combination according to claim 1 wherein the security system further comprises a third holding portion and the third holding portion is movable relative to each of the first and second holding portions and engages the portable device to cooperate with the first and second holding portions with the first and second holding portions in the engaged state to maintain the portable device connected to the security system.

18. A method of securing a portable device using a security system comprising first and second holding portions, a setting mechanism and an access assembly, the method comprising the steps of:

relatively repositioning the first and second holding portions into a release state;

placing the portable device in a preassembly position relative to the first and second holding portions with the first and second holding portions in the release state;

with the portable device in the preassembly position relatively repositioning the first and second holding portions from the release state into an engaged state wherein the portable device is held by the first and second holding portions;

placing the setting mechanism in an unsecured state wherein the first and second holding portions can be moved relative to each other between the engaged and release states;

placing the access assembly in a first state wherein the setting mechanism can be accessed at a first location to change the setting mechanism between the unsecured state and a secured state wherein the setting mechanism causes the first and second holding portions to be maintained in a desired relative position;

with the first and second holding portions in the engaged state and the access assembly in the first state accessing the setting mechanism at the first location and changing the setting mechanism from the unsecured state into the secured state; and changing the access assembly from the first state into the second state to thereby prevent access to the setting mechanism at the first location to change the setting mechanism from the secured state into the unsecured state.

19. The method of securing a portable device using a security system according to claim 18 further comprising the steps of connecting the security system to a base/support.

20. The method of securing a portable device using a security system according to claim 18 where the security system comprises a frame and further comprising the steps of providing a support, fixedly connecting the support to a base, and releasably connecting the frame to the support.

21. The method of securing a portable device using a security system according to claim 20 wherein there is a mounting element on the frame and a receptacle on the support and further comprising the step of directing the mounting element into the receptacle to maintain the portable device in a display state relative to the support.

22. The method of securing a portable device using a security system according to claim 18 wherein the security system further comprises a frame and further comprising the step of connecting a cable to the frame and to a base at a second location to thereby limit movement of the frame away from the second location.

23. The method of securing a portable device using a security system according to claim 22 wherein the cable comprises an electrically conductive element defining a conductive path and further comprising the step of providing a generator capable of producing a detectable signal in the event that the conductive path is interrupted.

24. The method of securing a portable device using a security system according to claim 18 wherein the portable device comprises a personal digital assistant device and further comprising the step of operating the personal assistant device with the personal digital assistant device operatively connected to the security system.

25. A security system for a portable device, the security system comprising:

a first holding portion and a second holding portion spaced from the first holding portion, the first and second holding portions being movable relative to each other to selectively change a spacing distance between the first and second holding portions, the first and second holding portions capable of engaging a portable device with the first and second holding portions in an engaged state and movable relative to each other from the engaged state to a release state;

a setting mechanism which can be selectively placed in a secured state and an unsecured state, the setting mechanism in the secured state causing the first and second holding portions to be maintained relative to each other in the engaged state, the setting mechanism in the unsecured state allowing the first and second holding elements to be moved relative to each other from the engaged state into the release state; and an access assembly having first and second states, the access assembly in the first state permitting the setting mechanism to be changed from the secured state into the unsecured state, the access assembly in the second state preventing the setting mechanism from being changed from the secured state into the unsecured state.

26. The security system according to claim 25 wherein the security system comprises a frame and the first holding portion is movable guidingly relative to the frame to change the spacing distance between the first and second holding portions.

27. The security system according to claim 26 wherein the frame defines an elongate slot and the first holding element has a post that is movable guidingly within the elongate slot to change the spacing distance between the first and second holding portions.

28. The security system according to claim 27 wherein the setting mechanism fixes the location of the post within the elongate slot.

29. The security system according to claim 28 wherein the post has a threaded portion and a nut is attached to the threaded portion and is tightened to place the setting mechanism in the secured state.

30. The security system according to claim 26 wherein the security system comprises a frame and the access assembly comprises a door that is guidingly movable relative to the frame between first and second positions corresponding respectively to the first and second states for the access assembly.

31. The security system according to claim 30 wherein the door in the second position blocks access to the setting mechanism from a first location and in the first position permits access to the setting mechanism from the first location to allow the setting mechanism to be changed between the secured and unsecured states.

32. The security system according to claim 26 wherein the security system comprises a frame and an elongate cable attached to the frame and a support.

33. The security system according to claim 32 wherein the security system further comprises a generator for a detectable signal and the elongate cable defines at least one electrically conductive path which, if interrupted, causes the generator to produce a detectable signal.

34. The security system according to claim 26 wherein the first holding portion defines a first receptacle into which a first portion of a portable device can project with the first and second holding portions in the engaged state.

35. The security system according to claim 34 wherein the second holding portion defines a second receptacle into which a second portion of a portable device can project with the first and second holding portions in the engaged state.

36. The security system according to claim 26 wherein the security system further comprises a third holding portion and the third holding portion is movable relative to each of the first and second holding portions and is engagable with a portable device to cooperate with the first and second holding portions with the first and second holding portions in the engaged state to maintain a portable device connected to the security system.

* * * * *